United States Patent [19]

Hödl et al.

[11] 4,395,026

[45] Jul. 26, 1983

[54] REFRACTORY GAS-PERMEABLE STRUCTURAL UNIT

[75] Inventors: Fritz Hödl, Vienna; Friedrich Kassegger, Wiener Neustadt, both of Austria

[73] Assignee: Arbed S.A., Luxembourg, Luxembourg

[21] Appl. No.: 277,218

[22] Filed: Jun. 25, 1981

[30] Foreign Application Priority Data

Jun. 25, 1980 [LU] Luxembourg ..... 82552
Jun. 25, 1980 [LU] Luxembourg ..... 82553
Jun. 25, 1980 [LU] Luxembourg ..... 82554

[51] Int. Cl.[3] ..... C21B 7/16
[52] U.S. Cl. ..... 266/265; 266/220
[58] Field of Search ..... 266/220, 265

[56] References Cited

U.S. PATENT DOCUMENTS 3,971,548 7/1976 Folgero ..... 266/218

*Primary Examiner*—P. D. Rosenberg
*Attorney, Agent, or Firm*—Michael J. Striker

[57] ABSTRACT

A refractory gas-permeable structural unit for blowing a gas into a metal treatment vessel and through its casing has at least two elements composed of refractory material and having abutting longitudinal faces provided with at least one metal layer, a metal housing surrounding the elements to connect them with one another and tightly abutting against other longitudinal faces of the elements, and a gas distribution chamber formed at an end face of the elements and communicating with a gas supply conduit.

26 Claims, 10 Drawing Figures

1
5
4
3
6
2
6
3
4
8
7

10
11
9

9
4
30
4

41
31
4

42
32
4

43
4
33

44
34
4
34

45
10
35

1
8
35
2
35
45

REFRACTORY GAS-PERMEABLE STRUCTURAL UNIT

BACKGROUND OF THE INVENTION

The present invention relates to a refractory gas-permeable structural unit for blowing a gas into a metal treatment vessel and through its casing.

The oxygen top-blowing methods used in pig iron refining, which are known under the names of "LD"-, "LDAC"-, "OLP"-, "BOF"-methods, are recently improved, as far as the metallurgy is concerned, in that secondary gases, such as nitrogen or argon, are blown under controlled conditions through the converter bottom. Also, in other metal treatment vessel like ladles for aftertreatment of steel or electric arc furnaces, the blowing of gas into the metal bath through the bottom of the vessel or the casing of the vessel wall is taken into consideration.

The gas-permeable refractory stones which are inserted into the casing of the bottom or the lateral wall of the vessel to perform the gas supply must satisfy the requirement that their stability must correspond to the stability of the refractory casing, inasmuch as an exchange of the connected gas-permeable stones in hot condition in a vessel bottom is substantially difficult. It is also necessary to provide the gas supply which can be continuous and also discontinuous; in other words, the vessel must be able to operate without gas supply, and after the repeated switching of the gas supply the stones must be gas-permeable in the same manner. Moreover, the gas-permeability of the stones during their service life, that is during the entire life of the furnace, must remain substantially constant.

The known gas-permeable stones of porous refractory material do not satisfy these requirements. Their stability in refining vessel is considerably smaller than the stability of the surrounding casing material. Thus, the porous stones embedded in the bottom of an oxygen converter withstand less than 100 charges, whereas the stability of the lining itself is 500 charges and more. Furthermore, a discontinuous gas supply is not possible with the porous stones; the metal penetrates into the pores of the stone and hardens there. After switching on the gas supply, the stone is no longer sufficiently gas-permeable.

In the patent application LU 81,208 applicants disclose a device which can be inserted into the bottom of a metal treatment vessel for blowing a treatment gas into a metal bath, which has a considerably improved stability with respect to the hitherto known gas-permeable stones, and which permits the blowing of the desired gas quantities. This device essentially consists of a refractory gas-permeable structural unit, whereby in an axial direction of the refractory material a plurality of flat, wave-like, pipe-like or wire-like metallic separating members of a low wall thickness are embedded. In accordance with one embodiment, this structural unit consists of steel sheet metal and segments or strips of refractory material in alternating disposition.

For manufacturing such a structural unit, it is necessary to cut a prefabricated block of refractory material into the required strips or segments, which is a very expensive manufacturing process. Since the segments have as a rule a very small thickness and a great length, the segments manufactured by compressing refractory "material" are not sufficiently easy to handle and warp when they are subjected to burning.

SUMMARY OF THE INVENTION

Accordingly, it is an object of the present invention to provide a refractory gas-permeable unit which avoids the disadvantages of the prior art.

More particularly, it is an object of the present invention to provide a refractory gas-permeable unit which is easy to manufacture and has segments with sufficient stability.

It is a further object of the present invention to provide a refractory gas-permeable structural unit which has an increased gas-permeability without affecting the high stability of the structural unit.

In keeping with these objects, and with others which will become apparent hereinafter, one feature of the present invention resides, briefly stated, in a gas-permeable structural unit which has at least two elements composed of a refractory material and abutting against one another with their first longitudinal faces, a metal layer arranged on at least one of the first longitudinal faces of the elements, a metal housing surrounding the elements to connect them with one another and sealingly abutting against second longitudinal faces of the elements, and a gas distribution chamber with a gas conduit formed at one end face of the elements.

The elements or segments may be composed of burnt or unburnt material, for example including a carbon-containing binder such as tar, pitch, plastic resin, or a chemical binder. A mortar layer may be provided between the second longitudinal faces of the elements and the metal housing.

In accordance with another feature of the present invention, the metal layer may be compressed with the refractory material of the elements. Because of the provision of the compressed metal layer, the manufacturing and handling of the relatively thin elements with great lengths is considerably facilitated, inasmuch as the metal layer serves as a reinforcement of the element, increasing the stability of the latter. The utilization of elements or bodies with compressed metal layers makes easier the assembling of several segments into a structural unit, inasmuch as the insertion of sheet plates can be dispensed with. Despite this, metal plate pairs may be inserted between the elements, if necessary.

In accordance with still another feature of the invention, the metal layer can lie on the refractory material of the elements, without being compressed with the latter. Whether the metal layer is compressed with the refractory material or it merely lies on the latter, a further feature of the invention resides in the fact that the neighboring longitudinal faces of the elements may be smooth or profiled, for example formed with wave-like or groove-like outer faces.

In accordance with still a further feature of the present invention, the elements may abut against one another with interposition of metal plates, metal plate pairs, and/or spacing members. The spacing members may be formed as portions of the metal layers which are shaped as corrugations or knubs, as sheet strip, as wires, or as combustible or vaporizable inserts, and so on.

In accordance with an additional feature of the present invention, an additional metal layer is provided on the first-mentioned metal layer compressed with the refractory material and formed as a sheet plate which is, for example, welded with the first-mentioned layer, whereas the abutting longitudinal face of the neighboring element is free of metal layers.

The profiling or shaping of the longitudinal faces of the elements of refractory material, formed as waves, grooves, notches, and so on, can be performed by cutting or milling of prefabricated elements. It is also possible to provide the profiling during the manufacture of the elements so that the pressing plunger or the shaping walls of the pressing mold is designed with a corresponding negative profile, and thereby the elements with the required profiling on the longitudinal faces are obtained.

The manufacture of the elements with the compressed metal layers having profiled outer faces can be performed in a simple way by providing the pressing plunger or the pressing mold wall with the respective profiling, such as wave-like or groove-like profiling, and introducing first a flat sheet plate and a refractory mass into the pressing mold. During the pressing step, the profiling of the compressed sheet plate is automatically obtained.

When the elements with the profiled metal layers are assembled, a structural unit is obtained which has gaps, passages through which the gas supply can be performed whereas the profiled longitudinal faces abut against smooth or profiled longitudinal faces of the neighboring element. The abutting longitudinal faces of the neighboring elements can in turn be provided with a compressed metal layer or they can be free of the latter.

In accordance with an additional feature of the present invention, some or all elements can be provided with at least a compressed-embedded pair of abutting metal inserts, for example sheet plates, embedded thereinto. Spacing members of the above mentioned type can be provided between the metal plates of the insert pair. The degree of gas-permeability can be varied in dependence upon the number of the embedded insert pairs as well as upon the construction of the spacing members.

When the compressed insert pairs are utilized, the structural unit can be manufactured in a simple way so that a portion of the refractory material is first introduced into the pressing mold, then the insert pair is introduced thereinto so that it extends over the entire length of the stone but only over a portion of the stone width, and finally another portion of the refractory material is introduced. When the structural unit has more than one insert pair, the process is repeated accordingly. Then the pressure is applied normal to the insert and the structural unit is molded. After removal of the unit from the press, the inserts are released at the end faces of the structural unit so as to make possible the gas passage. Instead of a plates pair, a folded sheet or a compressed pipe can be inserted into the elements. Moreover, multi-layer inserts, provided if necessary with spacing elements, can also be utilized.

The degree of gas permeability of the structural unit can be varied in dependence upon the number of insert pairs embedded in the element. Since the refractory material used for the structural unit corresponds to the material of the lining, the structural unit has the same stability as the surrounding lining. A premature replacement of the gas-permeable stones is not required.

It has been shown that the structural units can operate without gas supply. In this case, some metal penetrates into the naarrow slot between the inserts of one pair, and during the subsequent switching of the gas supply this metal is forced out of the structural unit so as to resume the original gas-permeability. This phenomenon remains during the entire lifetime of the structural unit in a considerably uniform manner.

The novel features which are considered characteristic for the invention are set forth in particular in the appended claims. The invention itself, however, both as to its construction and its method of operation, together with additional objects and advantages thereof, will be best understood from the following description of preferred embodiments when read in connection with the accompanying drawing.

DESCRIPTION OF THE PREFERRED EMBODIMENTS

Figures 1, 2, 3, 4, 5, 6, 7, 8:
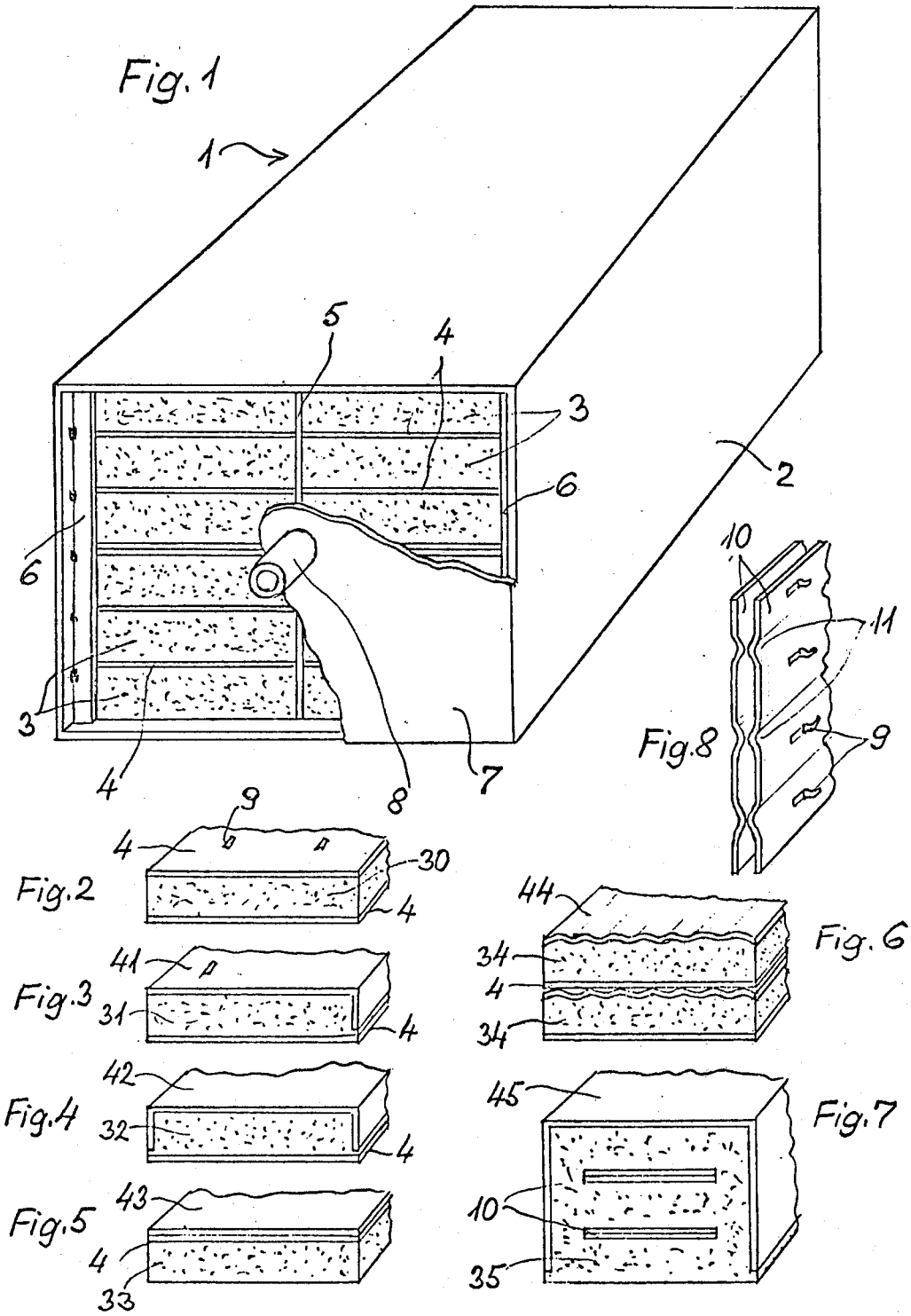
FIG. 1 is a view showing a refractory gas-permeable structural unit for blowing a gas into a metal treatment vessel, in accordance with a first embodiment of the invention.
FIGS. 2–7 are views showing elements of the inventive structural unit.
FIG. 8 is a view showing a structural unit with a compressed-embedded metal pair.

A refractory gas-permeable structural unit for blowing a gas into a metal treatment vessel and through its casing is shown in FIG. 1 and identified in toto by reference numeral 1. It has a metal housing 2 composed of several plates which are, for example, welded with one another. The housing embraces twelve elements or segments 3 arranged in two rows each containing six elements. Each element 3 has a compressed metal layer 4. Each element 3 abuts with its exposed lateral face against the inner surface of the metal housing 2, with interposition of a not shown mortar layer. Thereby, the undesirable gas passage which cannot be controlled, along the metal housing is prevented.

A sheet plate 5 is inserted between two rows of the segments 3. A gas passage can be performed along the sheet plate 5 as well as along the metal layer 4 of the segments 3. Instead of the sheet plate 5, also a plate pair can be arranged between the rows of the segments 3. The sheet plate 5 or the plate pairs can be connected by mortar.

The elements 3 are arranged at a distance from the end side of the metal housing because of the provision of two strips 6 which are provided at the inner side of the metal housing 2 and connected with the latter preferably by point welding. At this side, which is the cold side, an end plate 7 is sealingly welded and provided with a tubular connection 8. A space which is formed between the end sides of the elements 3 and the end plate 7 forms a distributing chamber for the gas.

The other side of the structural unit which is opposite to the end side 7 is the fire side of the structural unit and can be provided with a cover sheet. This cover sheet is utilized when the structural unit is surrounded by the metal treatment vessel lining with a tar and other carbon-containing materials. It prevents penetration of tar or other materials into the gas passage gaps of the structural element and hardening the same during heating of the vessel. The cover sheet melts in the beginning of the operation and releases the gap. A not shown bracket may also be provided in the region of the fire side of the structural unit, so that the structural unit can be suspended on a crane hook.

FIGS. 2, 3 and 4 show elements 30, 31 and 32 which have two, three or four longitudinal faces provided with compressed metal layers 4, 41 and 42. The metal layers may have claws 9 which extend into the refractory material of the elements for improved connection with the latter and are produced by punching out.

An element 33 which is shown in FIG. 5 has the compressed metal layer 4 and an additional second metal layer 43. The additional metal layer 43 is connected with the metal layer 4 by point welding. The segments 30, 31, 32 and 33 can be inserted into the structural unit of FIG. 1 instead of the elements 3.

FIG. 6 shows an element 34 which is provided with profiled and corrugated metal layer 44 at its one longitudinal face and the flat metal layer 4 at its other longitudinal face. When the segments 34 are assembled with one another, a passage for the gas extends in the longitudinal direction of the structural unit.

FIG. 7 shows an element 35 which can replace three elements 3 of the structural unit of FIG. 1. The element 35 has a compressed metal layer 45 and two pairs of sheet inserts 10 which extend over the entire length of the element 35 but at the same time extend only over a portion of its width. In dependence upon the desired gas permeability, the insert 10 may be formed as smooth sheet strips or, as shown in FIG. 8, as shaped sheet strips provided with corrugations or grooves 11 forming spacing members. The insert 10 may be provided with the claws 9 for improving their connection with the refractory material of the elements.

Figure 9:
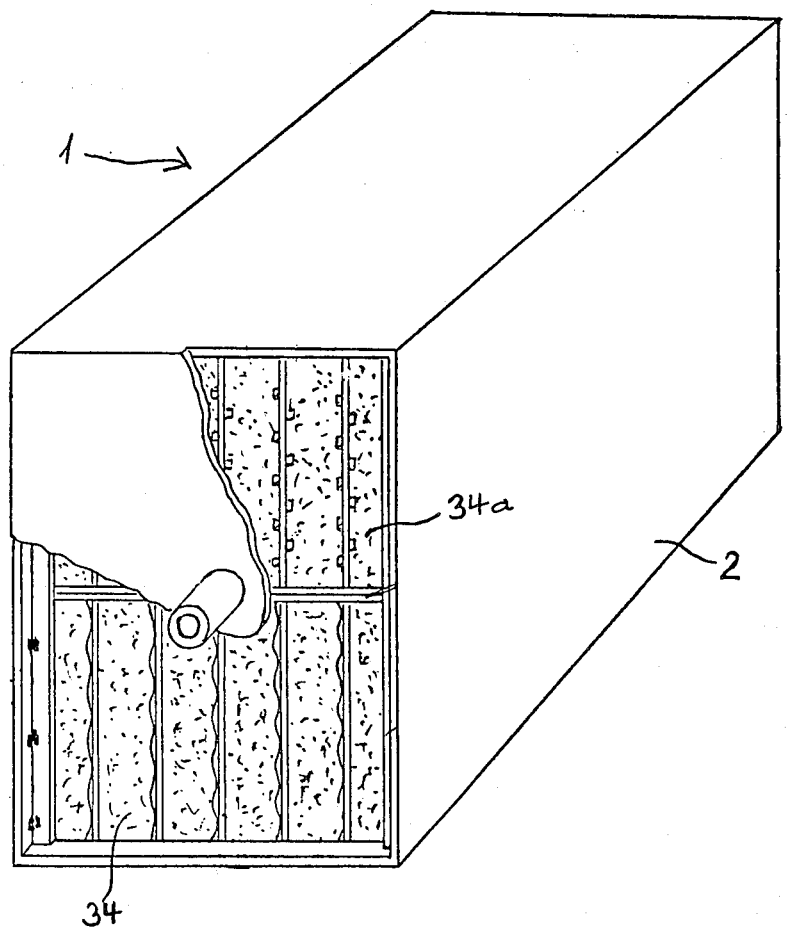
FIG. 9 is a view substantially corresponding to the view of FIG. 1, but showing another embodiments of the invention with the elements shown in FIG. 6.

The structural unit 1 shown in FIG. 9 has the metal housing 2 surrounding twelve elements which are arranged in rows each containing six elements. Each element is provided at its longitudinal side with a profiling. More particularly, the upper elements 34 have profiling shaped as grooves, whereas the lower elements 34 have profiling shaped as waves. In practice, however, all segments have generally identical profiling.

Flat sheet plates are located in the gaps between two neighboring segments of each row. However, the inserts with profiling can also be inserted therebetween. An insert shaped as a sheet plate pair is arranged between two rows.

Figure 10:
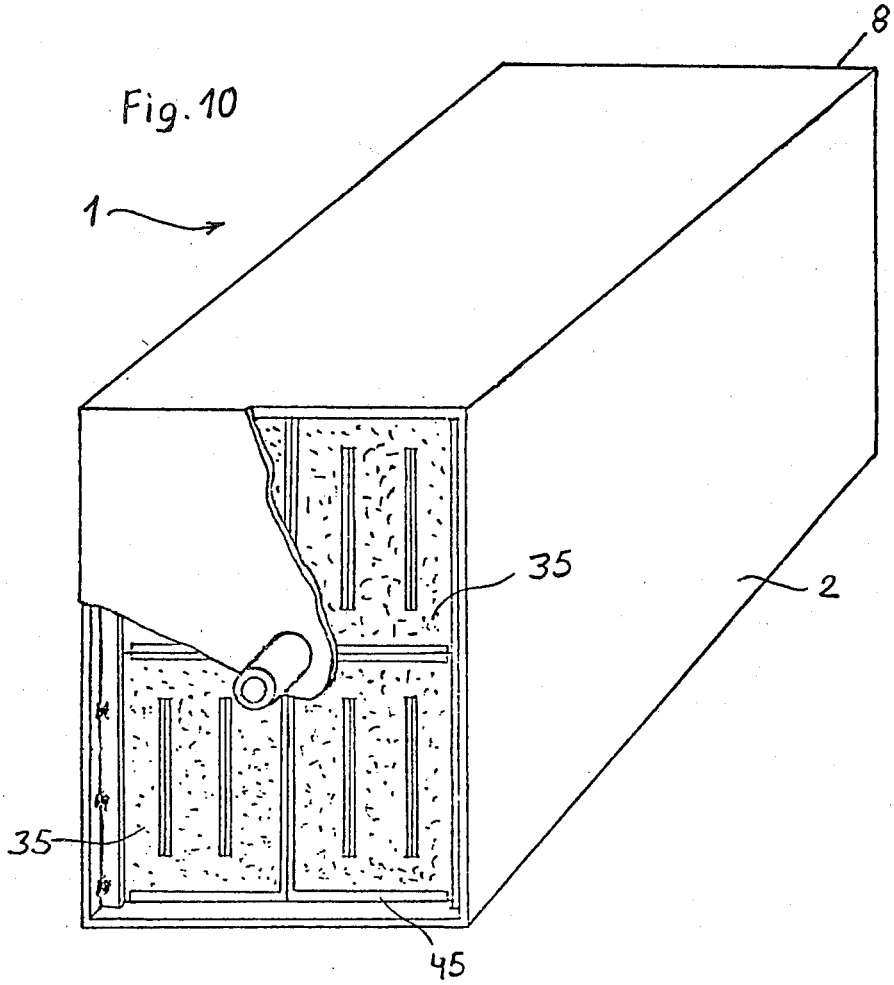
FIG. 10 is a view substantially corresponding to the view of FIG. 1 but showing a further embodiment of the invention with the elements shown in FIG. 7.

The structural unit 1 shown in FIG. 10 has the metal housing 2 which embraces four segments 35. The segments abut with their U-shaped compressed metal layers 45 against one another. The exposed longitudinal sides of the segments abut against the inner surface of the housing which is composed, for example, of plates welded with one another.

The metal inserts may be composed of a steel sheet which, for example, has a thickness between 0.5 and 3 mm and may be provided with a surface protection, if necessary. The elements may be composed, for example, of tarbound mass of magnesia having the following composition and granule structure:

| Sinter magnesia | | Granule structure | |
|---|---|---|---|
| MgO | 96.2 weight % | 5–8 mm | 20 weight % |
| $Fe_2O_3$ | 0.2 weight % | 3–5 mm | 15 weight % |
| $Al_2O_3$ | 0.1 weight % | 1–3 mm | 20 weight % |
| CaO | 2.5 weight % | 0–1 mm | 20 weight % |

-continued

| Sinter magnesia | | Granule structure | |
|---|---|---|---|
| $SiO_2$ | 1.0 weight % | 0–0.1 mm | 25 weight % |

The sintered magnesia is provided with 4 wt.-% of coal tar pitch as a binder. Also other tars, pitches, plastic resins and the like may be utilized as binders.

A further mass for manufacturing a stone to be utilized in the structural element in accordance with the present invention has the following composition and granule structure:

| Prereacted magnesia-chrome ore-sinter granular | | Chrome ore |
|---|---|---|
| MgO | 53.8 weight % | 17.1 weight % |
| $Cr_2O_3$ | 19.2 weight % | 53.2 weight % |
| $Al_2O_3$ | 4.2 weight % | 10.4 weight % |
| $Fe_2O_3$ | 9.8 weight % | — |
| FeO | — | 15.9 weight % |
| CaO | 1.8 weight % | 0.1 weight % |
| $SiO_2$ | 1.2 weight % | 3.3 weight % |
| Granule | | |
| sinter granular | 3–5 mm | 20 weight % |
| sinter granular | 1–3 mm | 25 weight % |
| sinter granular | 0–1 mm | 25 weight % |
| sinter granular | 0–0-1 mm | 20 weight % |
| chrome granular | 0–0.7 mm | 10 weight % |

The components are mixed for chemical binding with 3.7 wt.-% of kieserite solution with a density of 1.22 g/cm$^3$.

The invention is, however, not limited to the above-mentioned refractory materials. Other refractory materials also can be utilized, such as for example mixtures of magnesia and chrome ore, a high-alumina material.

The inventive structural unit possesses a sufficient gas permeability, whereas the gas passage is performed through the gaps between the individual elements, on the one hand, and through the gaps between the metal inserts, on the other hand. The elements themselves possess practically no gas permeability, and thereby the refractory material utilized for the structural unit corresponds to the lining of the metal treatment vessel. Thereby the gas-permeable structural element has the same stability as the surrounding lining, and a premature replacement of the gas-permeable structural unit is avoided.

In accordance with the present invention, each gap in the structural unit through which a gas passage is performed must be provided with a metal plate, either formed as a metal layer on the elements, or formed as metal plates arranged between the elements. As mentioned above, these metal layers or metal plates prevent penetration of metal from the metal bath of the treatment vessel into the gaps, and also in the event of the treatment of pig iron which, because of its consistency and viscosity, has an especially considerable inclination to penetrate into the gaps.

This phenomenon may be explained by the fact that the metal plates arranged in the gas-permeable gaps provide for a cooling action, and the heat is conveyed fast to cold end faces of the structural elements. Thereby, the penetrated metal to be treated hardens after a short stroke (several centimeters). When the gaps are not provided with metal plates or metal layers, the penetration of metal up to the cold end face is observed.

It should be mentioned that not only the metal inserts, but also the metal layers may be formed of steel sheet. The metal layers or the metal plates between the elements may be formed similar to the metal inserts 10. More particularly, they may have spacing members formed as corrugations or knubs in the metal layers or metal plates, and also as wires, metal strips, or combustible or vaporizable insertable members arranged between the metal layers or metal plates.

It will be understood that each of the elements described above, or two or more together, may also find a useful application in other types of constructions differing from the types described above.

While the invention has been illustrated and described as embodied in a refractory gas-permeable structural unit for blowing a gas into a metal treatment vessel and through its casing, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A refractory gas-permeable structural unit for blowing a gas into a metal treatment vessel and through its casing, characterized by a passageway formed by faces of at least two elongated refractory elements, said elements being separated from one another by a thin metal layer so that gas passage takes place between said elements along said metallic layer, said elements each having first and second longitudinal faces and hot and cold end faces, said metallic layer being arranged on the first longitudinal face of at least one of said elements; a metal housing surrounding said elements to connect them with one another and sealingly abutting against said second longitudinal faces of said elements; and means for supplying gas and including a gas distribution chamber formed at said first end faces of said elements and a conduit communicating with said distribution chamber.

2. A structural unit as defined in claim 1, wherein said elements are composed of a material having a carbon-containing binder selected from the group consisting of tar, pitch and plastic resin.

3. A structural unit as defined in claim 1, wherein said elements are composed of a material having a chemical binder.

4. A structural unit as defined in claim 1, and further comprising a mortar layer provided between said second longitudinal face of each of said elements and said metal housing.

5. A structural unit as defined in claim 1, wherein said metal layer is compressed with the refractory material of a respective one of said elements.

6. A structural unit as defined in claim 1, wherein said metal layer lies on the refractory material at said one first longitudinal face of each of said elements.

7. A structural unit as defined in claim 1, wherein said metal layer also has longitudinal faces, said longitudinal faces of said elements and of said metal layer being smooth.

8. A structural unit is defined in claim 1, wherein said metal layer also has longitudinal faces, said longitudinal faces of said elements and of said metal layer being formed as shaped faces.

9. A structural unit as defined in claim 8, wherein said longitudinal faces of said elements and of said metal layer are corrugated.

10. A structural unit as defined in claim 8, wherein said longitudinal faces of said elements and of said metal layer are provided with grooves.

11. A structural unit as defined in claim 1, and further comprising an additional metal layer arranged on said first-mentioned metal layer of said one element, the first longitudinal face of the other of said elements being free from said metal layers.

12. A structural unit as defined in claim 11, wherein said additional metal layer is connected with said first metal layer by welding.

13. A structural unit as defined in claim 1; and further comprising a pair of metal inserts abutting against one another compressed and embedded into at least one of said elements so as to form said metal layer.

14. A structural unit as defined in claim 13, wherein said embedded metal inserts are formed as metal sheets.

15. A structural unit as defined in claim 14; and further comprising spacing members provided between said embedded metal inserts.

16. A structural unit as defined in claim 15, wherein said metal inserts have shaped portions which form said spacing members.

17. A structural unit as defined in claim 16, said shaped portions of said metal inserts which form said spacing members are shaped as corrugations.

18. A structural unit as defined in claim 15, wherein said portions of said metal inserts which form said spacing members are shaped as knubs.

19. A structural unit as defined in claim 15, wherein said spacing members between said metal inserts are formed by wires.

20. A structural unit as defined in claim 15, wherein said spacing members between said metal inserts are formed by metal strips.

21. A structural unit as defined in claim 15, wherein said spacing members between said metal inserts are formed as insertable members composed of a material selected from the group consisting of a combustible material and a vaporizable material.

22. A structural unit as defined in claim 1, wherein said metal layer is composed of a steel sheet.

23. A structural unit as defined in claim 22, wheein said steel sheet forming said metal layer is provided with a surface protection.

24. A structural unit as defined in claim 1, wherein said metal layer is provided with a plurality of claws for improving retention of said metal layer in the refractory material of a respective one of said elements.

25. A structural unit as defined in claim 13, wherein said metal inserts are provided with a plurality of claws for improving retention of said metal inserts in the refractory material of a respective one of said elements.

26. A structural unit as defined in claim 1, wherein the structural unit has a plurality of passageways arranged for gas passage and each provided with a metal layer.

* * * * *